US005158237A

United States Patent [19]

Wellman

[11] Patent Number: 5,158,237

[45] Date of Patent: Oct. 27, 1992

[54] CEREAL GRAIN CLEANING SYSTEM

[75] Inventor: Warner Wellman, Omaha, Nebr.

[73] Assignee: ConAgra, Inc., Omaha, Nebr.

[21] Appl. No.: 808,022

[22] Filed: Dec. 13, 1991

[51] Int. Cl.[5] ..... B02B 5/02

[52] U.S. Cl. ..... 241/10; 241/9

[58] Field of Search ..... 241/9, 10, 6, 7, 24, 241/68; 426/483

[56] References Cited

U.S. PATENT DOCUMENTS

| | | | |
|---|---|---|---|
| 866,942 | 9/1907 | Little | 241/9 X |
| 2,962,230 | 11/1960 | Dilley et al. | 241/9 |
| 4,583,455 | 4/1986 | Salete-Garces . | |
| 4,744,523 | 5/1988 | High et al. | 241/10 X |
| 5,089,282 | 2/1992 | Wellman . | |

OTHER PUBLICATIONS

Henry Simon, Gravity Selector, Henry Simon Limited, Stockport Cheshire, England.

SGS, Gravity Selector T/10-T/20, Aspetti 232, Italy.

Carter Day, Disc Separators, CD-DS90.

*Primary Examiner*—Douglas D. Watts

*Attorney, Agent, or Firm*—Willian Brinks Olds Hofer Gilson & Lione

[57] ABSTRACT

A method for cleaning a cereal grain such as wheat includes the steps of separating a quantity of incoming wheat into a light fraction and a heavy fraction. The light fraction is then cleaned by passing it through a vertically oriented treatment chamber defined between inner and outer chamber walls. The inner chamber wall includes a set of inner abrasive elements and the outer chamber wall includes a set of outer abrasive elements and a screen. One of the sets of abrasive elements is rotated with respect to the other and a gas is forced through the treatment chamber. In this way, a substantial fraction of any oats in the cereal grain is fragmented. The light fraction is aspirated after it is passed through the treatment chamber to clean the light fraction further. Conventional scouring and tempering steps can then be used.

7 Claims, 3 Drawing Sheets

CEREAL GRAIN CLEANING SYSTEM

BACKGROUND OF THE INVENTION

This invention relates to a simple, low cost method for cleaning cereal grains such as wheat, barley and the like.

Conventionally, cereal grains such as wheat are cleaned prior to further processing such as milling. In general, when the cereal grain being cleaned is wheat, the primary objectives are (1) to remove foreign material, particularly grains other than wheat such as corn, beans, oats and seeds; (2) to remove wheat with little or no endosperm, such as shrivelled or shrunken wheat grains and weather damaged kernels; (3) to remove infested or contaminated kernels in order to reduce insect fragment counts and microbiological counts of the processed grain; and (4) to remove dust adherent to wheat kernels in order to reduce microbiological counts.

In the past, disc machines, impact machines and scouring machines have been used in various combinations to perform these cleaning functions. Though these prior art approaches have been effective, a need presently exists for an improved grain cleaning process which exhibits reduced operating costs, maintenance costs, capital costs, and space requirements as compared with the prior art cleaning systems, without reducing the quality of the cleaned product.

SUMMARY OF THE INVENTION

According to the cleaning method of this invention, a quantity of an incoming cereal grain selected from the group consisting of wheat, barley, rye and sorghum, is separated into at least two fractions comprising a light fraction and a heavy fraction. The light fraction is then cleaned by passing it through a vertically oriented treatment chamber defined by inner and outer chamber walls, wherein the inner chamber wall comprises a set of inner abrasive elements and the outer chamber wall comprises a set of outer abrasive elements and at least one screen. One of the sets of abrasive elements is rotated with respect to the other, and a gas is forced through the treatment chamber. In this step, a substantial fraction of any oats present in the cereal grain is fragmented. The cleaned light fraction is then aspirated to produce a cleaned cereal grain.

DETAILED DESCRIPTION OF THE PRESENTLY PREFERRED EMBODIMENTS

Figure 1:
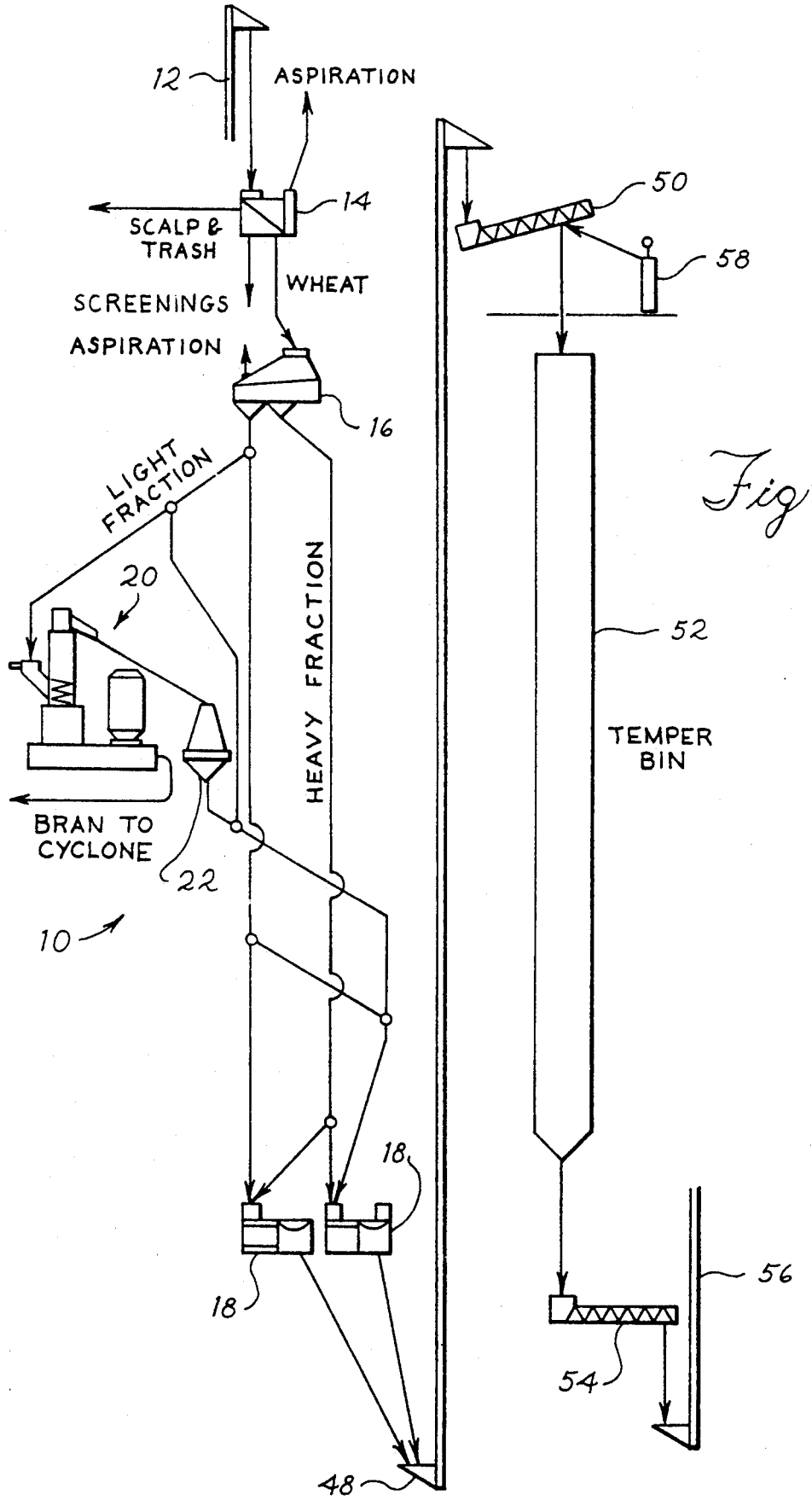
FIG. 1 is a flow diagram of a wheat cleaning system that incorporates a presently preferred embodiment of this invention.

Turning now to the drawings, FIG. 1 shows a wheat cleaning system 10 which incorporates a presently preferred embodiment of this invention. As shown in FIG. 1, incoming wheat is raised by a lift 12 and applied as a feedstock to a milling separator 14. The milling separator 14 is a conventional prior art device which uses multiple screens to separate the incoming wheat into three streams: scalp and trash that remain above the upper screen, small seeds and other debris that pass through both screens, and wheat that remains between the two screens and is further processed.

As shown in FIG. 1, the wheat stream from the milling separator 14 is applied to a gravity selector 16. The gravity selector is a conventional prior art device which separates the incoming wheat into two streams, a light fraction and a heavy fraction, based on the specific gravity of the wheat. The gravity selector 16 is adjusted so that 15 to 30 percent by weight of the incoming wheat is diverted to the light fraction. The light fraction will include an increased concentration of foreign material, wheat with little or no endosperm, infested or contaminated kernels, and dust. In the conventional manner, the heavy fraction is passed directly from the gravity selector 16 to one or more dry wheat scourers 18, where additional material is removed from the wheat.

Figure 2:
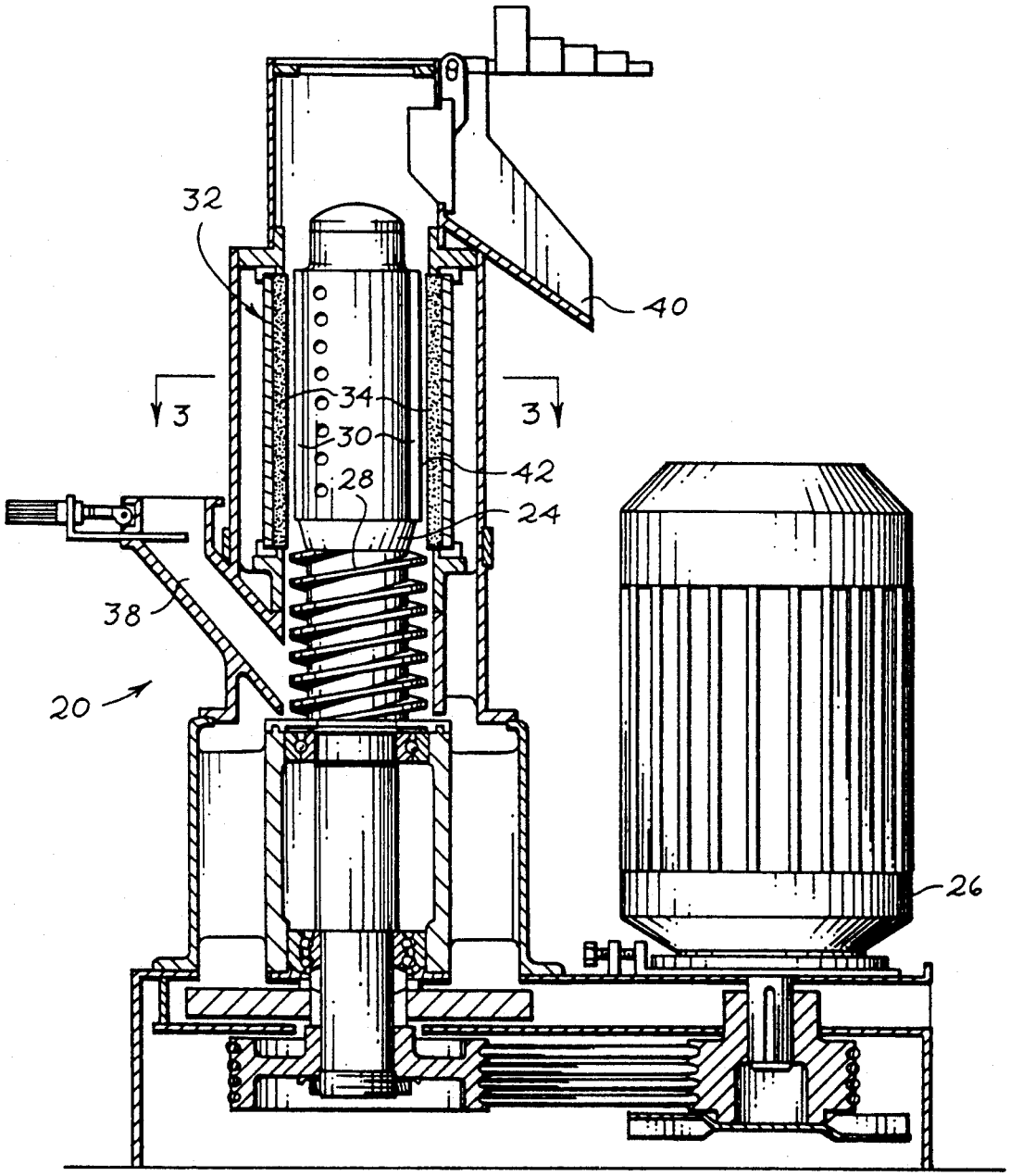
FIG. 2 is an elevational sectional view of a cleaning machine included in the system of FIG. 1.
Figure 3:
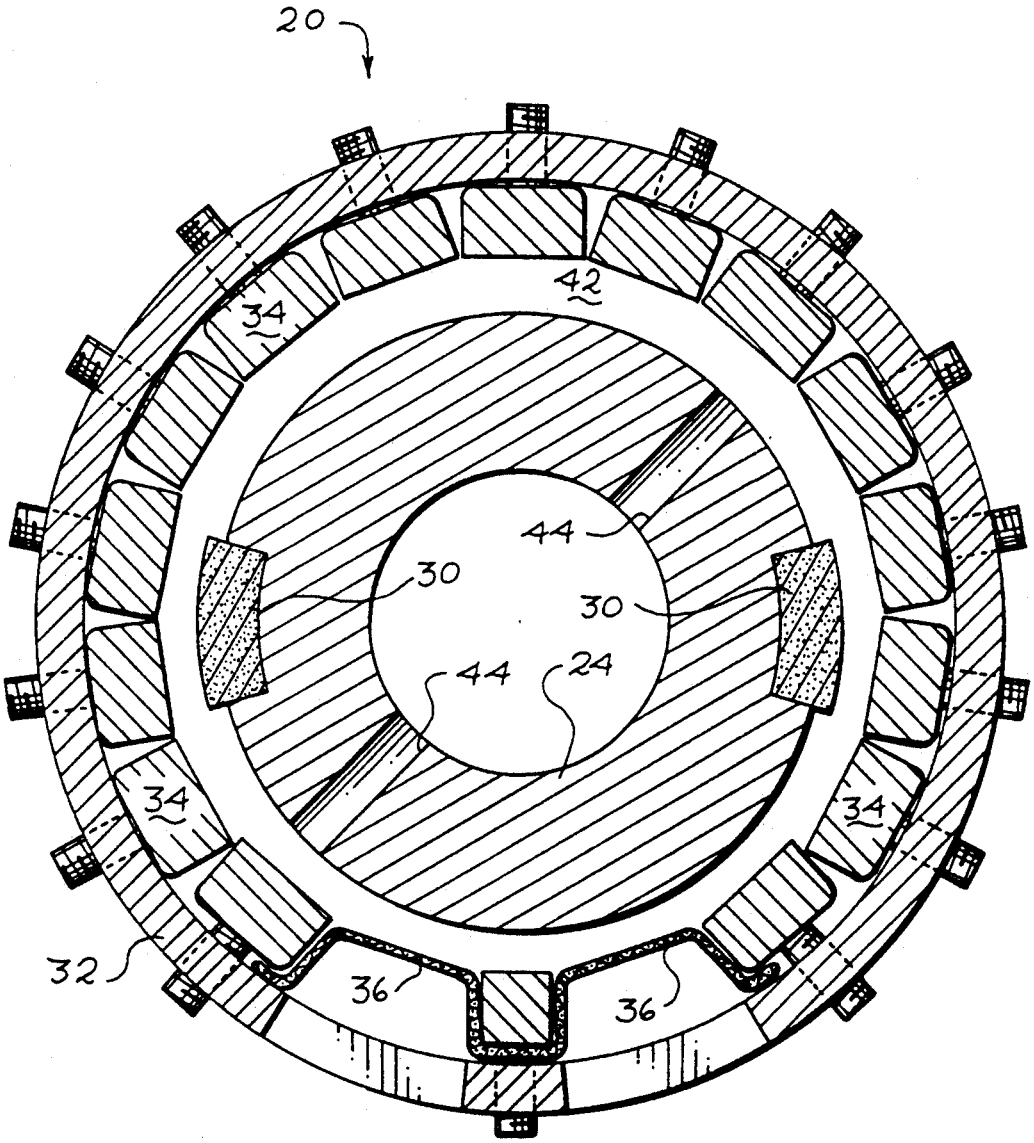
FIG. 3 is a cross-sectional view taken along line 3—3 of FIG. 2.

According to this invention, the light fraction from the gravity selector 16 is applied as an input to a wheat cleaning system that includes a vertical cleaning machine 20 and an aspirator 22. The cleaning machine 20 in its preferred form is shown in elevation in FIG. 2 and in cross-section in FIG. 3. The cleaning machine 20 includes a central rotor 24 which is mounted for rotation by a motor 26. The rotor 24 defines a screw flight 28 at its lower end and a pair of opposed abrasive elements 30 at its upper end. The upper portion of the rotor 24 is surrounded by a basket 32 which includes a set of outer abrasive elements 34 and a pair of screens 36 (FIG. 3). The region between the rotor 24 and the basket 32 forms a treatment chamber 42 having an inner wall bounded in part by the abrasive elements 30 and an outer wall bounded by the outer abrasive elements 34 and the screens 36. An inlet port 38 conducts incoming wheat to the region of the screw flight 28, and an outlet port 40 allows wheat to exit the treatment chamber 42. In use, the rotor 24 is rotated by the motor 26 and a compressed gas such as air, nitrogen or any other suitable nonreacting gas is forced up through an interior portion of the rotor 22 out passages 44 through the treatment chamber 42 and out the screens 36. Incoming wheat passes from the inlet port 38 to the region of the screw flight 28 where the wheat is forcibly raised and passed through the treatment chamber 42. As the wheat passes through the treatment chamber 42, it is abraded by the abrasive elements 30, 34, and adjacent grains of wheat are forced into frictional contact with each other and with the screens 36.

The cleaning machine 20 has been found to clean the wheat effectively. Oats are fragmented and then easily removed. Many seeds are small enough to pass through the screens 36 directly. The cleaning machine 20 also removes garlic, which is soft and therefore readily fragmented in the treatment chamber 42.

Wheat that has passed through the treatment chamber 42 and out the outlet port 40 is supplied to the aspirator 22, where air flow is used to separate seeds, dust, fragmented oats and fragmented garlic from the sound wheat. The sound, cleaned wheat from the aspirator 22 is then introduced to the scourers 18 for additional treatment.

Cleaned wheat from the scourers 18 is transported by a lift 48 to a wheat mixing conveyor 50 where water is added to the wheat. The wheat is then conducted to a tempering bin 52 for a conventional tempering step. After a suitable tempering time (such as 4.5 hours), the wheat is transferred by a conveyor 54 and a lift 56 for additional processing. Such additional processing may include conventional milling, or pearling followed by milling as described in U.S. patent applications Ser. No. 07/557,631, 07/610,819, and 07756,927, all assigned to the assignee of the present invention. If desired chlorine can be added as shown at 58 prior to introduction of the wheat into the tempering bin 52.

The following information is provided in order better to define the best mode of the invention presently contemplated by the inventor. This information is of course intended only by way of illustration, and is in no way intended to limit the scope of this invention.

The milling separator 14 may be of the type marketed by Remo as the Model 1016S Milling Separator. The gravity selector 16 may be of the type marketed by Sangatti as the Model A1600. The cleaning machine 20 may be identical in structure to the pearling machine described in U.S. patent application Ser. No. 07/756,927, assigned to the assignee of the present invention. This cleaning machine is related to the pearling machine described in U.S. Pat. No. 4,583,455. Preferably, the cleaning machine 20 is operated to remove about 3 wt.% of the incoming wheat. The aspirator 22 may be a turbo aspirator such as that marketed by Ocrim as the Model 450. The dry wheat scourers 18 may be of the type marketed by Bühler.

The wheat cleaning system 10 described above provides excellent cleaning of hard, soft and durum wheat. The system 10 is particularly simple and low in maintenance requirements, and it requires a relatively low amount of capital equipment which is sturdy and reliable in use. Significantly, the operating costs of the system 10 are lower than the system it replaced because of reduced air and power requirements. Additionally, the capital costs, maintenance costs, and space requirements of the system 10 are all lower than the prior art system it replaced.

Of course, this invention is not limited to use with wheat, but is also suited for use with other cereal grains such as barley, rye and sorghum. Other alternatives are possible. For example, the gravity selector 16 can be replaced by a gravity table, sifters and aspirators. The pearling machine 20 can be modified as to the nature and number of the abrasive elements 30, 34, and to the number and size of the screens 36.

It is therefore intended that the foregoing detailed description be regarded as illustrative rather than limiting, and that it be understood that it is the following claims, including all equivalents, which are intended to define the scope of this invention.

I claim:

1. A method for cleaning a cereal grain selected from the group consisting of wheat, barley, rye, and sorghum, said method comprising the following steps:

a) separating a quantity of an incoming cereal grain selected from the group consisting of wheat, barley, rye and sorghum into at least two fractions comprising a light fraction and a heavy fraction;

b) cleaning the light fraction by passing the light fraction through a vertically oriented treatment chamber defined between inner and outer chamber walls, said inner chamber wall comprising a set of inner abrasive elements and said outer chamber wall comprising a set of outer abrasive elements and a screen, while rotating one of the sets of abrasive elements with respect to the other and forcing a gas through the treatment chamber, thereby fragmenting a substantial fraction of any oats in the cereal grain; and c) aspirating the light fraction after it has passed through the treatment chamber to clean the light fraction further.

2. The method of claim 1 further comprising the following step:

d) tempering the cleaned light fraction and the heavy fraction.

3. The method of claim the cereal grain consists essentially of wheat.

4. The method of claim 3 comprising the further step of passing the aspirated light fraction and the heavy fraction through a dry wheat scourer prior to the tempering step (d).

5. The method of claim 1 wherein step (a) is arranged such that no more than about 30% of the incoming cereal grain is separated into the light fraction.

6. The method of claim 1 wherein step (a) comprises the step of passing the incoming cereal grain through a gravity selector.

7. The method of claim 3 wherein steps (b) and (c) are arranged to remove about 3 wt.% of the light fraction.

* * * * *

UNITED STATES PATENT AND TRADEMARK OFFICE

CERTIFICATE OF CORRECTION

PATENT NO. : 5,158,237

DATED : October 27, 1992

INVENTOR(S) : Wellman

It is certified that error appears in the above-identified patent and that said Letters Patent is hereby corrected as shown below:

Column 4:

In Claim 3, line 1, after "claim" please insert --2 wherein--.

Signed and Sealed this

Fifth Day of April, 1994

Bruce Lehman

*Attest:*

BRUCE LEHMAN

*Attesting Officer*

*Commissioner of Patents and Trademarks*